US007515122B2

(12) United States Patent
Miller et al.

(10) Patent No.: US 7,515,122 B2
(45) Date of Patent: Apr. 7, 2009

(54) COLOR DISPLAY DEVICE WITH ENHANCED PIXEL PATTERN

(75) Inventors: Michael E. Miller, Honeoye Falls, NY (US); Michael J. Murdoch, Rochester, NY (US); Paul J. Kane, Rochester, NY (US); Andrew D. Arnold, Hilton, NY (US); Serguei Endrikhovski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 941 days.

(21) Appl. No.: 10/859,314

(22) Filed: Jun. 2, 2004

(65) Prior Publication Data

US 2005/0270444 A1 Dec. 8, 2005

(51) Int. Cl.
*G09G 3/30* (2006.01)

(52) U.S. Cl. ..... 345/76; 345/696; 315/169.3

(58) Field of Classification Search ..... 345/87, 345/60, 75.2, 76, 82, 83, 89, 589, 696, 697, 345/698; 382/298; 315/169.3, 169.4; 349/108; 313/500

See application file for complete search history.

(56) References Cited

U.S. PATENT DOCUMENTS

| | | | | |
|---|---|---|---|---|
| 5,113,274 | A * | 5/1992 | Takahashi et al. | 349/109 |
| 5,339,092 | A * | 8/1994 | Johnson et al. | 345/611 |
| 5,341,153 | A * | 8/1994 | Benzschawel et al. | 345/694 |
| 5,485,293 | A * | 1/1996 | Robinder | 345/88 |
| 5,781,257 | A * | 7/1998 | Gal et al. | 349/57 |
| 6,188,385 | B1 * | 2/2001 | Hill et al. | 345/614 |
| 6,366,025 | B1 * | 4/2002 | Yamada | 315/169.3 |
| 6,384,839 | B1 * | 5/2002 | Paul | 345/613 |
| 7,113,231 | B2 * | 9/2006 | Conner et al. | 349/5 |
| 7,184,066 | B2 * | 2/2007 | Elliot et al. | 345/694 |
| 2002/0008812 | A1 * | 1/2002 | Conner et al. | 349/106 |
| 2002/0024618 | A1 * | 2/2002 | Imai | 348/743 |
| 2002/0186214 | A1 * | 12/2002 | Siwinski | 345/212 |
| 2004/0080479 | A1 * | 4/2004 | Credelle | 345/88 |
| 2004/0080696 | A1 * | 4/2004 | Kanazawa et al. | 349/130 |
| 2004/0195963 | A1 * | 10/2004 | Choi et al. | 313/504 |
| 2004/0222999 | A1 * | 11/2004 | Choi et al. | 345/589 |

(Continued)

FOREIGN PATENT DOCUMENTS

| | | |
|---|---|---|
| EP | 1 388 818 | 2/2004 |

(Continued)

*Primary Examiner*—Abbas I. Abdulselam
(74) *Attorney, Agent, or Firm*—Andrew J. Anderson; Raymon L. Owens

(57) ABSTRACT

A color display device, comprising: an array of subpixels of at least four different colors, including at least two relatively higher luminous color subpixels and at least two relatively lower luminous color subpixels, wherein the subpixels are arranged into groups forming at least two distinct types of pixels, each pixel type including the two relatively higher luminous color subpixels and at least one of the two relatively lower luminous color subpixels, and wherein the pixel types are arranged in a pattern such that the relative locations of the two relatively higher luminous color subpixels in each pixel is repeated in adjacent pixels, and the relative location of at least one of the two relatively lower luminance color subpixels is not repeated in at least one adjacent pixel. Various embodiments of the invention enable color display devices with improved image display quality, with both the appearance of jagged lines and the appearance of banding reduced simultaneously.

3 Claims, 10 Drawing Sheets

U.S. PATENT DOCUMENTS

2004/0234163 A1* 11/2004 Lee et al. ..... 382/298

FOREIGN PATENT DOCUMENTS

JP 59-119679 11/1984
JP 60-263122 * 11/1984
JP 6-263122 12/1985
WO WO 02/101644 12/2002

* cited by examiner

COLOR DISPLAY DEVICE WITH ENHANCED PIXEL PATTERN

FIELD OF THE INVENTION

The present invention relates to color display devices and, more particularly, to arrangements of subpixel elements in such color display devices.

BACKGROUND OF THE INVENTION

U.S. Patent Application Publication 2002/0186214A1, by Siwinski, published Dec. 12, 2002, shows a method for saving power in an organic light emitting diode (OLED) display having pixels comprised of red, green, blue and white light emitting subpixel elements. The white light emitting subpixel elements are more efficient than the other colored light emitting subpixel elements and are employed to reduce the power requirements of the display. In such a display, the red, green, blue and white light emitting subpixel elements can be illuminated to create any desired color within the gamut of the red, green, and blue light emitting subpixel elements. However, since the white light emitting subpixel elements are more efficient than the red, green, or blue light emitting subpixel element it is desirable to present any neutral color by turning on only the white light emitting subpixel element within a pixel containing the four light emitting subpixel elements.

While power efficiency is always desirable, it is particularly desirable in portable applications because an inefficient display limits the time the device can be used before the power source is recharged. In fact, for certain applications the rate of power consumption may be more important than any other display characteristic with the exception of visibility.

It has been known for many years that the human eye is most sensitive to greenish yellow light and less sensitive to red and blue light. More specifically, the spatial resolution of the human visual system is driven primarily by the luminance rather than the chrominance of a signal. Since green light provides the preponderance of luminance information in typical viewing environments, the spatial resolution of the visual system during normal daylight viewing conditions is highest for green light, lower for red light, and even lower for blue light when viewing images generated by a typical color balanced image capture and display system. This fact has been used in a variety of ways to optimize the frequency response of imaging systems.

U.S. Patent Application Publication 2002/0024618 A1, by Imai, published Feb. 28, 2002, describes a pixel having a square array of red, green, blue and white light emitting subpixel elements. This pattern may be commonly referred to as a quad pattern. A portion of a display device 10 showing an array of four such pixels 12 through 18 are shown in FIG. 1. As shown in this figure colors green G and white W having relatively large luminance components are positioned diagonally opposite. At the same time colors red R and blue B produce much less luminance energy than the green and white light emitting subpixel elements. However, because the exact pattern is repeated pixel to pixel, light is often emitted by one or two subpixel elements that are positioned close to one another and, therefore, banding artifacts (i.e., the visibility of dark lines within a row or column of the pixel structure) can be quite visible in this pattern.

It is known in the art to provide pixel patterns with red R, green G, and blue B stripes. A portion of such a display device 20 is shown in FIG. 2. As shown in this figure, a pixel 22 contains red R, green G, and blue B light emitting subpixel elements. Neighboring pixels are positioned within a grid around this pixel such that they are aligned in rows and columns. As with the quad pattern this pixel pattern can exhibit banding artifacts in regions of flat pure primary colors.

It is also known in the art that when relatively large pixels are displayed on a small display or when graphics image regions are likely to be shown that demand a uniform appearance, rows of light emitting subpixel elements may be offset horizontally to reduce the visibility of banding in a display device 30 as shown in FIG. 3. Commonly referred to as a delta pattern this pattern includes a similar pixel 32, having red R, green G, and blue B light emitting elements. However, unlike the stripe pattern, this pattern reduces the visibility of banding and improves the uniform appearance in areas of constant color by shifting the alignment of the red, green, and blue subpixel elements in alternating rows. Unfortunately, this pattern creates a visible jagged pattern in vertical lines containing primarily green light emitting subpixel elements as the human eye is very sensitive to offsets in light emitting subpixel elements that are high in luminance.

In European Patent Specification EP 0330361B1, issued Apr. 21, 1993, Stewart et. al. describe a display device for producing straight vertical and horizontal, and upwardly and downwardly sloping alpha-numeric lines. The pixels of the device were composed of cells ranked in order of brightness: brightest (W), bright (G), medium (R) and darkest (B). In that description the brightest and bright cells were required to be aligned substantially parallel to one axis. Additionally, it was required that the bright and darkest cells were diagonally aligned. However, because the exact pattern is repeated pixel to pixel, light is often emitted by one or two subpixel elements that are positioned close to one another and, therefore, banding artifacts (i.e., the visibility of dark lines within a row or column of the pixel structure) can be quite visible in this pattern. Additionally, if it is necessary to have cells with unequal area, it is difficult to resize these elements to maintain a symmetric pattern with straight horizontal and vertical gaps between the cells to allow electrical lines to pass through. It is also known to provide an OLED display having pixels with differently sized red, green and blue light emitting subpixel elements, wherein the relative sizes of the subpixel elements in a pixel are selected to extend the service life of the display. See, e.g., U.S. Pat. No. 6,366,025 B1, issued Apr. 2, 2002 to Yamada.

There is a need, therefore, for an improved pixel pattern for color display devices that improves the uniformity of a pattern and yet avoids the visibility of jagged vertical or horizontal lines. Ideally, this pixel pattern will provide the enhanced power savings that is available, e.g., from a pattern containing red, green, blue and white subpixels and allow the relative sizes of the light emitting subpixel elements to be readily adjusted.

SUMMARY OF THE INVENTION

In accordance with one embodiment, the invention is directed towards a color display device, comprising: an array of subpixels of at least four different colors, including at least two relatively higher luminous color subpixels and at least two relatively lower luminous color subpixels, wherein the subpixels are arranged into groups forming at least two distinct types of pixels, each pixel type including the two relatively higher luminous color subpixels and at least one of the two relatively lower luminous color subpixels, and wherein the pixel types are arranged in a pattern such that the relative locations of the two relatively higher luminous color subpixels in each pixel is repeated in adjacent pixels, and the relative location of at least one of the two relatively lower luminance color subpixels is not repeated in at least one adjacent pixel.

ADVANTAGES

Various embodiments of the invention enable color display devices with improved image display quality, with both the appearance of jagged lines and the appearance of banding reduced simultaneously.

DETAILED DESCRIPTION OF THE INVENTION

In accordance with various embodiments described herein, the invention is directed towards a color display device, comprising: an array of subpixels of at least four different colors, including at least two relatively higher luminous color subpixels and at least two relatively lower luminous color subpixels, wherein the subpixels are arranged into groups forming at least two distinct types of pixels, each pixel type including the two relatively higher luminous color subpixels and at least one of the two relatively lower luminous color subpixels, and wherein the pixel types are arranged in a pattern such that the relative locations of the two relatively higher luminous color subpixels in each pixel is repeated in adjacent pixels, and the relative location of at least one of the two relatively lower luminance color subpixels is not repeated in at least one adjacent pixel. In one preferred embodiment, the relatively higher luminous color subpixels are selected from white, green, yellow or cyan subpixels, and the relatively lower luminous color subpixels are blue and red subpixels.

Research conducted by the present inventors has shown that subpixel elements that bear a significant portion of a display device luminance may be aligned between adjacent pixels within a pattern in accordance with the invention to avoid the appearance of jagged lines. However, subpixel elements that provide a smaller proportion of the display luminance are less likely to provide visible spatial patterns, and need not be aligned between adjacent pixels. The relative positions of subpixel elements that provide a smaller proportion of the display luminance may thus be distributed evenly, switching positions between adjacent pixels, and such locations may contribute to an improvement of the display image uniformity of the pattern.

Figure 4:
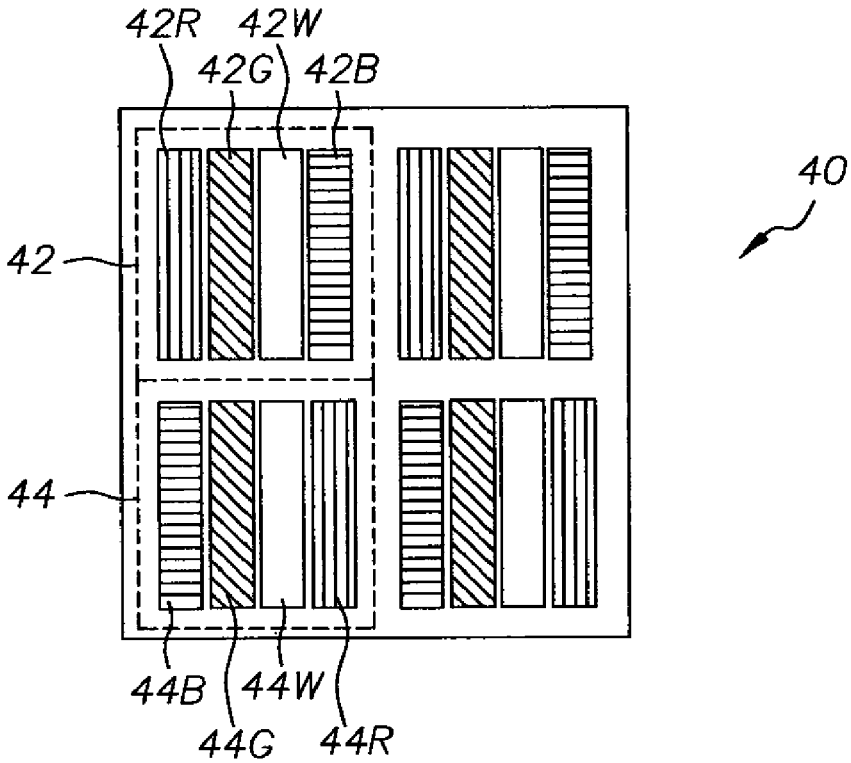
FIG. 4 is a schematic diagram showing an arrangement of light emitting subpixel elements according to one embodiment of the present invention.

In one embodiment of the invention, each of the two distinct pixel types employed include the two relatively lower luminous color subpixels, and the pixel types are arranged such that the relative locations of the two relatively lower luminance color subpixels are interchanged between adjacent pixels in successive rows and/or columns of pixels. Referring to FIG. 4, e.g., a display panel 40 (a small portion of which is shown) according to the present invention includes a repeating array of two distinct types of pixels 42 and 44. Each pixel is composed of a red R, a green G and a blue B light emitting subpixel element that define the gamut of the display and an additional subpixel element W that emits light having a color within the gamut (e.g. white). Within this pattern, the white and green light emitting subpixel elements are arranged in vertical columns while the blue and red light emitting subpixel elements are separated within the pattern.

The additional subpixel element W is preferably constructed to have a power efficiency that is higher than the power efficiency of at least one of the red R, green G, and blue B light emitting subpixel elements. According to this embodiment of the present invention, the additional light emitting subpixel element provides a greater peak luminance contribution than the peak luminance of either the red or blue subpixel elements. It is well known that the green subpixel element also provides a greater peak luminance contribution than either the red or blue subpixel elements.

Within this pattern, the white W and green G light emitting subpixel elements are aligned such that the position of each of these subpixel elements is the same for each pixel within the display device 40. For example, comparing the position of the white W and green G light emitting subpixel element within pixels 42 and 44, one can see that the green 42G and 44G light emitting subpixel element is the second light emitting within each pixel. Further, the white light emitting subpixel element 42W and 44W is the third light emitting subpixel element within each pixel. Since, these subpixel elements present the majority of the luminance information, positioning the white W and the green G light emitting subpixel elements in horizontal rows and vertical columns, the visibility of jagged lines are avoided within the pattern.

Looking at pixels 42 and 44, one can further see that the positions of the red R and blue B light emitting subpixel elements are not the same within these two pixels. In fact the red light emitting subpixel element 42R in one pixel 42 is the first light emitting subpixel element but in the second row the red light emitting subpixel element 44R is the fourth light emitting subpixel element. Additionally, the blue light emitting subpixel element in the first pixel 42B is the fourth light emitting subpixel element but in the succeeding row, the blue light emitting subpixel element 44B is the first light emitting subpixel element. Thus, alternating rows of pixels in the display comprise a first pixel type wherein the subpixels are positioned in a sequence of red, green, white and blue rectangles, whose long axes are oriented vertically, and whose long axes are parallel to each other, said sequence of subpixels in said alternating rows of pixels repeating across the width of the display; and interleaving rows of pixels between the alternating rows in the display comprise a second pixel type wherein the subpixels are positioned in a sequence of blue, green, white and red rectangles, whose long axes are oriented vertically, and whose long axes are parallel to each other, the sequence of subpixels in the interleaving rows of pixels repeating across the width of the display. The sequences of subpixels in alternating and interleaving rows repeat across the height of the display. While the rectangular subpixels are illustrated as being of equal width and length, they may independently be selected to be of different width or length. By separating the red and blue light emitting subpixel elements within the repeating array of light emitting subpixel elements, the uniformity of the pattern is improved and the visibility of banding artifacts are significantly reduced. The fact that this arrangement of light emitting subpixel elements allows both the appearance of jagged lines and the appearance of banding to be reduced simultaneously provides an improvement in overall image quality that has been demonstrated by the present inventors to be greater than it is in patterns where the visibility of only one of these artifacts are reduced at the expense of increasing the visibility of the other.

Figure 5:
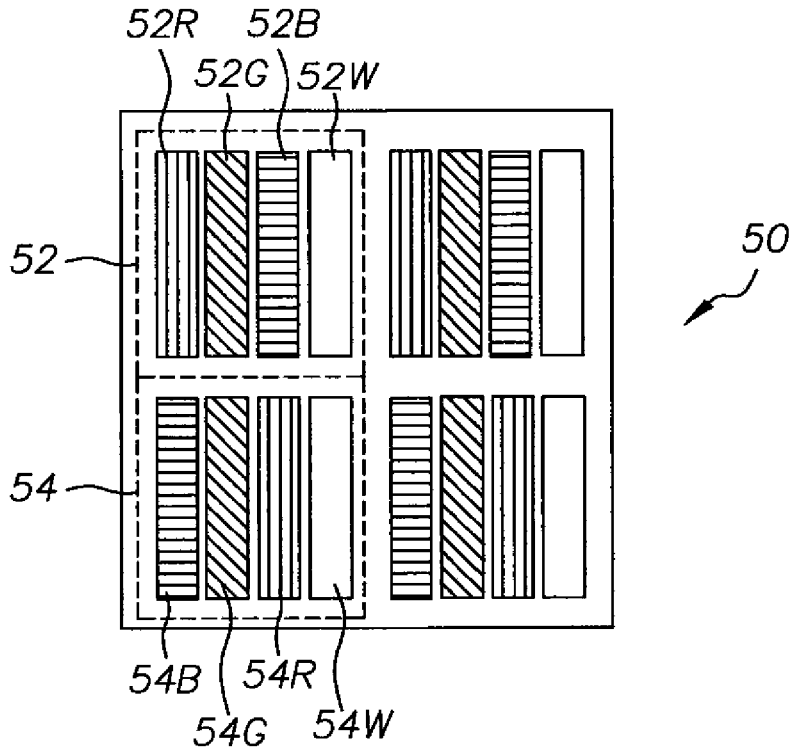
FIG. 5 is a schematic diagram showing an arrangement of light emitting subpixel elements according to another embodiment of the present invention.

Referring to FIG. 5, a display panel 50 (a small portion of which is shown) includes an alternative arrangement of light emitting subpixel elements within a repeating array of two distinct types of pixels 52 and 54. This arrangement of red R, green G, blue B, and white W light emitting subpixel elements is similar to the one shown in FIG. 4. However, the white W and green G columns of pixels are separated to provide a pattern that is more uniform in appearance. As in the previous figure, columns and rows of the luminance bearing light emitting subpixel elements (i.e., white and green) are aligned vertically. That is, 52W and 54W, as well as 52G and 54G are aligned in vertical columns. However, in succeeding rows, the position of the blue B and red R light emitting subpixel elements are displaced in succeeding rows. As shown in FIG. 5 the red light emitting subpixel element 52R is located in the same column and above the blue light emitting subpixel element 54B. Similarly, the blue light emitting subpixel element 52B is located in the same column and above the red light emitting subpixel element 54R. As in the previous described embodiment, the sequences of subpixels in alternating and interleaving rows repeat across the height of the display.

Figure 6:
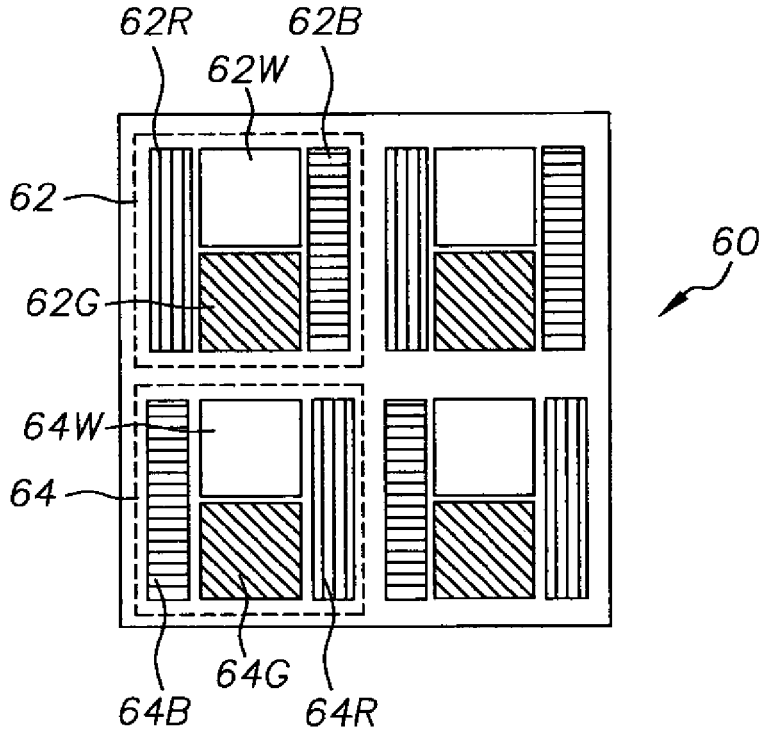
FIG. 6 is a schematic diagram showing an arrangement of light emitting subpixel elements according to another embodiment of the present invention.

An alternative embodiment is shown in FIG. 6. This figure shows a small portion of a display panel 60, including an alternative arrangement of light emitting subpixel elements within a repeating array. This figure shows two distinct types of pixels 62 and 64. The white W and green G light emitting subpixel elements are located in the same location within each pixel. However, as before, the position of the red R and blue B light emitting subpixel elements are interchanged between each vertical pair of pixels. That is, the white (62W and 64W) and green (62G and 64G) are located the same within pixels 62 and 64. However, the position of the red (62R and 64R) and blue (62B and 64B) are interchanged in succeeding rows of pixels. As in the previous described embodiments, the sequences of subpixels in alternating and interleaving rows repeat across the height of the display. As in the previous arrangements providing a fixed position for the elements that bear the majority of the luminance information (G and W) avoids the visibility of jagged lines, while interchanging the location of the red and blue light emitting elements reduces the appearance of banding.

Figure 1:
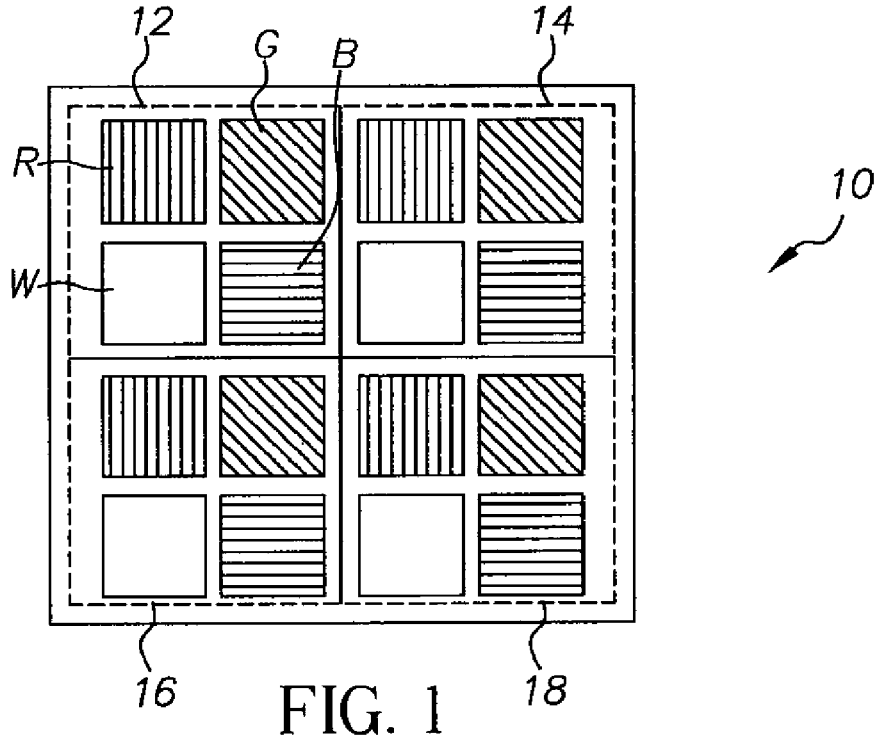
FIG. 1 (PRIOR ART)
FIG. 1 is a schematic diagram showing an arrangement of light emitting subpixel elements forming four pixels in a quad arrangement (prior art).
Figure 2:
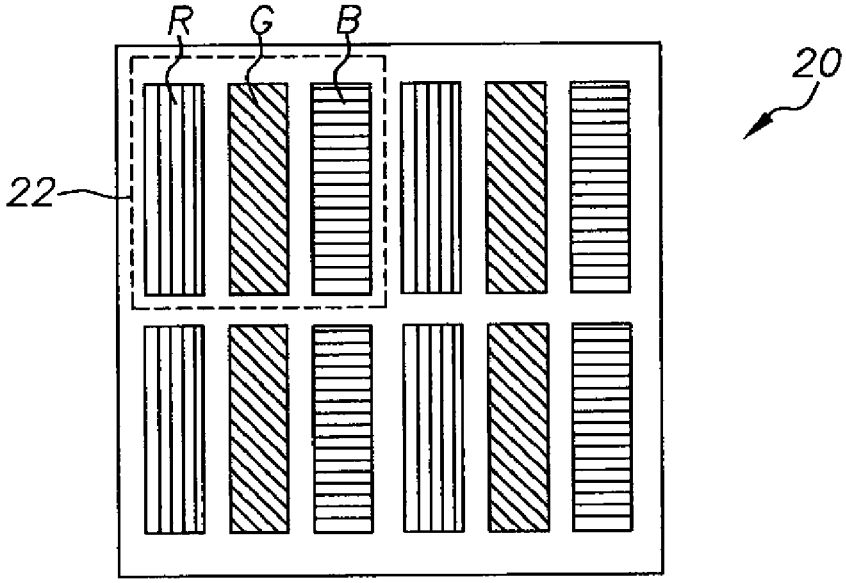
FIG. 2 (PRIOR ART)
FIG. 2 is a schematic diagram showing an arrangement of light emitting subpixel elements forming four pixels in a stripe arrangement (prior art).
Figure 3:
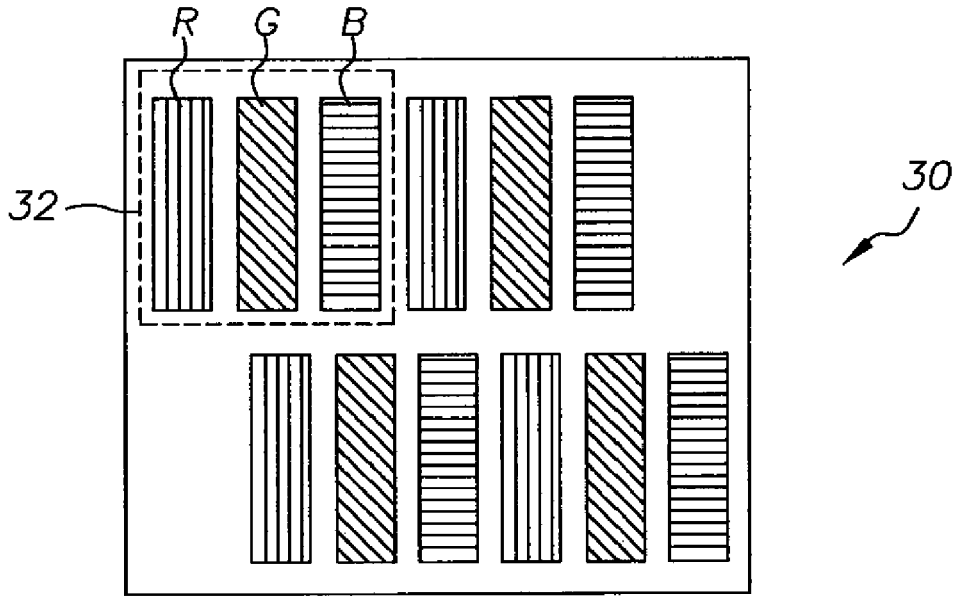
FIG. 3 (PRIOR ART)
FIG. 3 is a schematic diagram showing an arrangement of light emitting subpixel elements forming four pixels in a delta arrangement (prior art)
Figure 7:
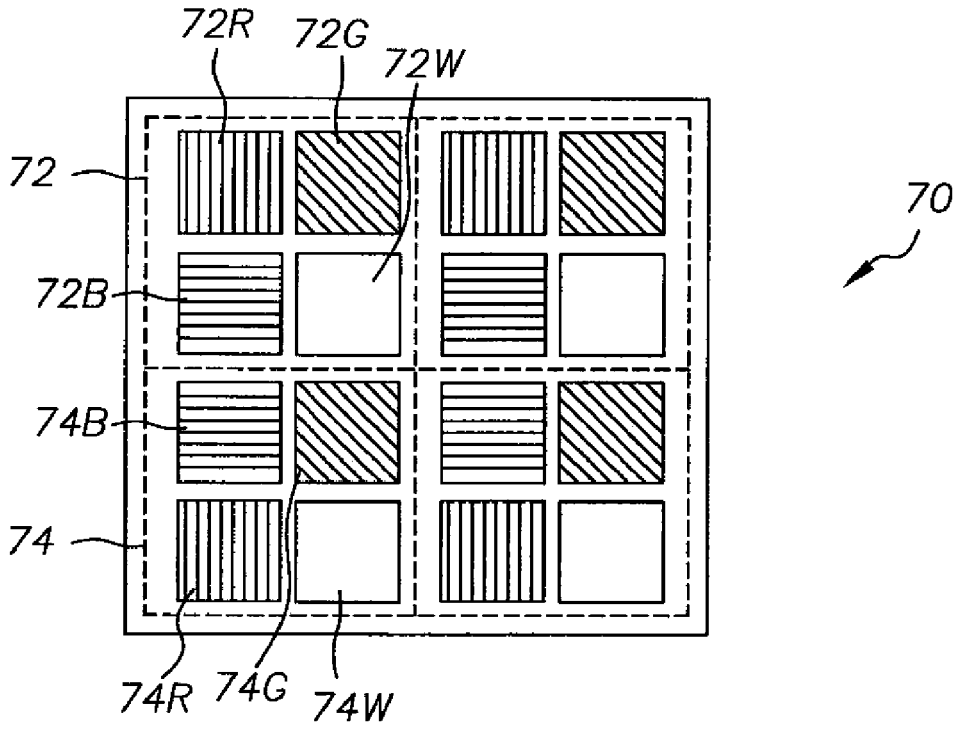
FIG. 7 is a schematic diagram showing an arrangement of light emitting subpixel elements according to another embodiment of the present invention.

An alternate embodiment of the present invention is shown in FIG. 7. A small portion of a display panel 70 is shown that includes four pixels. This is a departure from the quad pattern of FIG. 1 and those known previously in the art. The two distinct types of pixels 72 and 74 each contain green subpixels (72G and 74G) and white pixels (72W and 74W). These G and W subpixels are aligned with respect to the vertical axis, and are located in the same position within pixels 72 and 74. However, as in FIG. 6, the position of the red (72R and 74R) and blue (72B and 74B) subpixels are interchanged in succeeding rows of pixels. As in the previous described embodiments, the sequences of subpixels in alternating and interleaving rows repeat across the height of the display. The interchange principle of low luminance subpixels of the present invention is used, resulting in a pattern that is better optimized to the situation where characters, pictorial detail and uniform areas must all be displayed.

Figure 8:
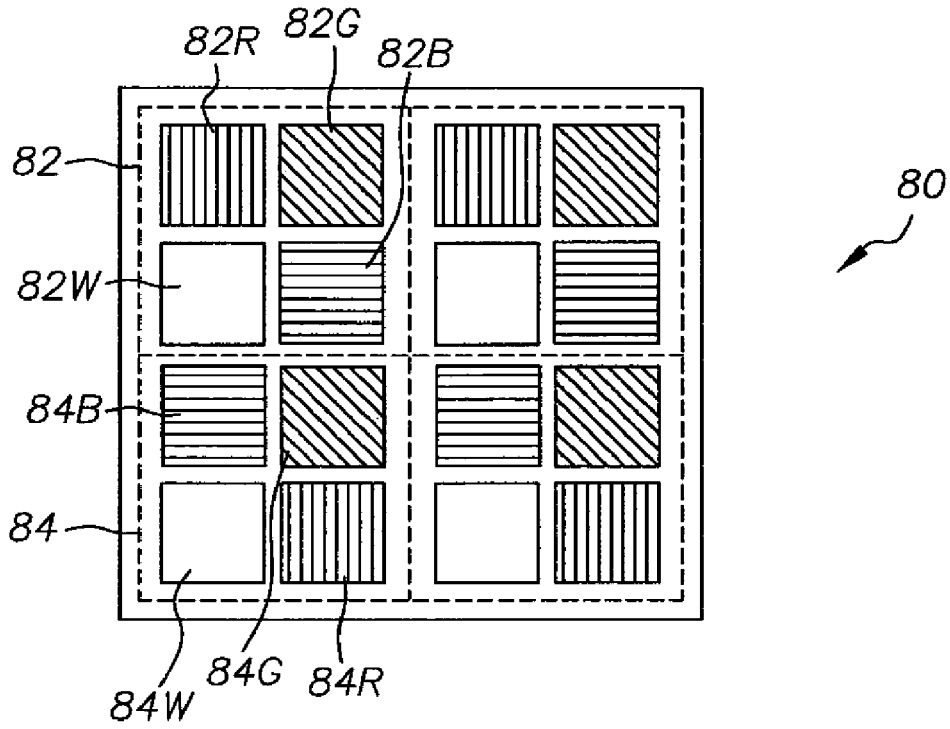
FIG. 8 is a schematic diagram showing an arrangement of light emitting subpixel elements according to another embodiment of the present invention.

Another embodiment of the present invention is shown in FIG. 8. A small portion of a display panel 80 is shown that includes four pixels. In particular, distinct types of pixels 82 and 84 each contain high luminance subpixels 82G, 82W and 84G, 84W. In this case, the G and W subpixels are not aligned with respect to each other within the pixel cell, however they are seen to remain in a fixed relative position inside the pixel cell as one moves from pixel to pixel. Hence the G and W maintain their overall alignment with respect to themselves, while the R and B subpixels (82R, 82B, 84R, 84B) alternate positions between rows of pixels. As in the previous described embodiments, the sequences of subpixels in alternating and interleaving rows repeat across the height of the display.

Figure 9:
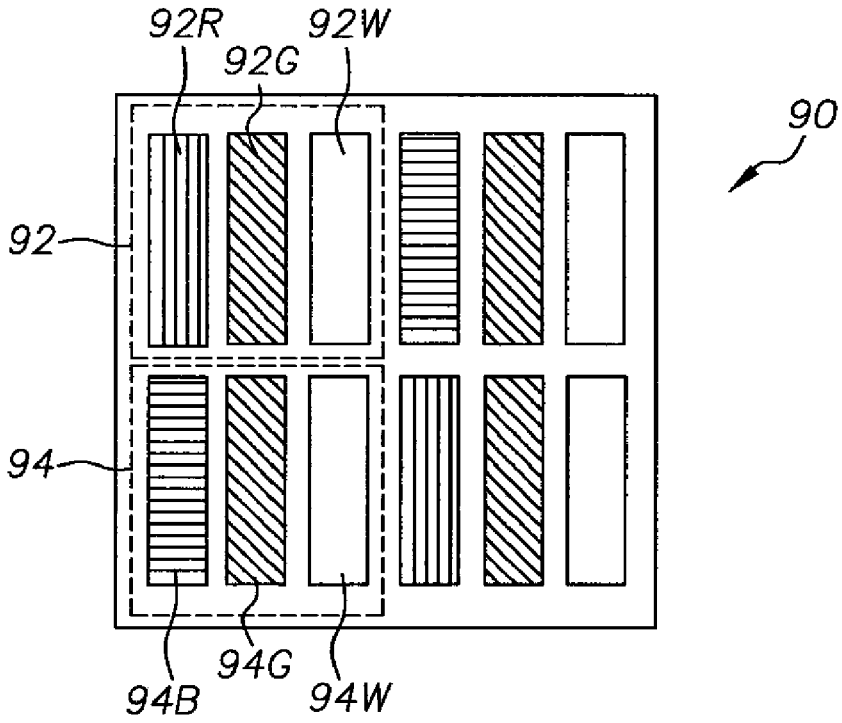
FIG. 9 is a schematic diagram showing an arrangement of light emitting subpixel elements according to one embodiment of the present invention.

It is known in the art that the human eye is less sensitive to spatial structure for the light emitting subpixel elements that carry little luminance information. It is further known in the art to subsample these subpixel elements (i.e., include fewer and/or larger light emitting subpixel elements that carry little luminance information than light emitting subpixel elements that carry a larger proportion of the luminance information). Subsampling the pattern shown in FIG. 5, an alternative embodiment of the invention is shown in FIG. 9. This figure shows a small portion of a display panel 90, including four pixels. Experiments conducted by the present inventors have demonstrated that when this pattern of light emitting subpixel elements replaces the patterns of light emitting subpixel elements such as the ones shown in FIG. 4, FIG. 5 or FIG. 6, while applying an equal number of light emitting subpixel elements per area, a sharper and more uniform image appearance results. Alternatively, fewer light emitting subpixel elements per area may be employed, allowing a larger proportion of each pixel to emit light. This is beneficial to the lifetime of emissive displays.

As with the earlier patterns, the white W and green G light emitting subpixel elements are located at the same location within each pixel. Looking at FIG. 9, the white (92W and 94W) and green (92G and 94G) light emitting subpixel elements are located at the same position within each pixel. However, due to the fact that the red R and blue B light emitting subpixel elements are subsampled, each pixel contains only one of these two subpixel elements. The red 92R light emitting subpixel element is located in every other pixel. The blue 94B light emitting subpixel element is also located in every other pixel and the blue 94B light emitting subpixel element is located at the same location in pixel 94 as the red 92R light emitting subpixel element is located in pixel 92. The fact that these two pixels are interchanged in successive rows and columns of pixels, reduces the visibility of banding and significantly improves the uniformity of the pattern. As in the previous described embodiments, the sequences of subpixels in alternating and interleaving rows repeat across the height of the display.

To optimize a display device for various applications, differently sized light emitting subpixel elements may be used. Studies conducted by the present inventors have shown that saturated colors occur less frequently than unsaturated colors in both natural and computer generated images and graphics. Hence the efficiency of a display can be improved by using the additional subpixel element in the place of the gamut defining subpixel elements. Moreover, the use of the additional subpixel element can be so high in typical applications that in order to reduce the current density in the additional subpixel element, it is useful to increase the size of the additional subpixel element. Using the example of OLED displays, typical OLED materials presently in use have a relatively higher efficiency for the additional subpixel element and the green subpixel element, and a relatively lower efficiency for the red and blue subpixel elements. Therefore, an optimized display according to the present invention may have relatively larger red, blue and additional subpixel elements, and relatively smaller green subpixel elements. For example, in applications for which the use of black-and-white or low saturation colors dominates, the additional white OLED subpixel elements will be used more heavily than any of the gamut defining subpixel elements and may therefore be increased in size to reduce the current density and hence aging of the additional subpixel element. Text, graphic, and pictorial based applications are typically of these types.

Figure 10:
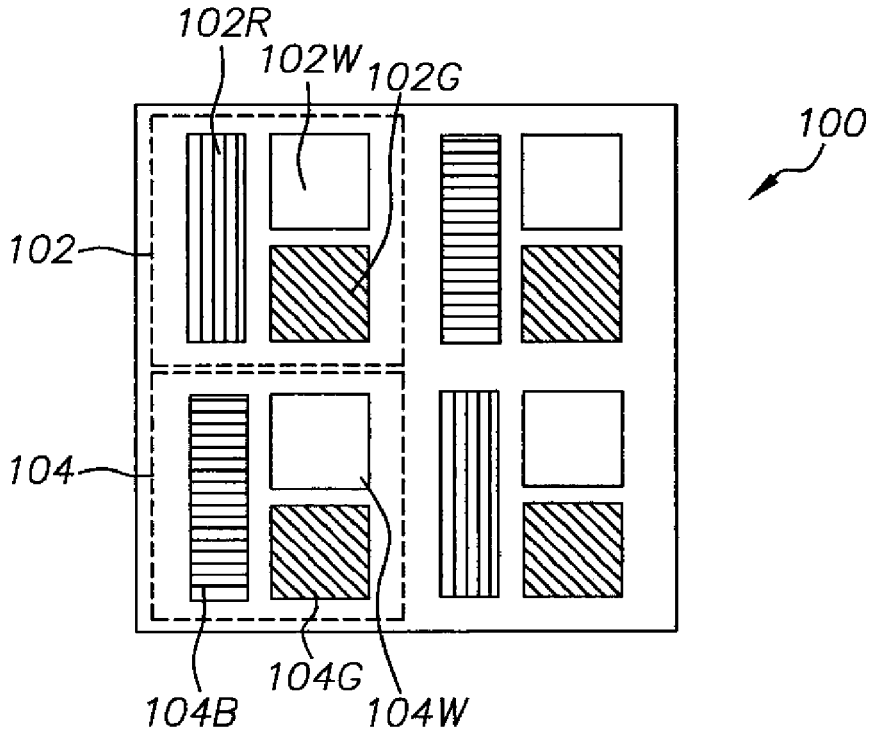
FIG. 10 is a schematic diagram showing an arrangement of light emitting subpixel elements according to another embodiment of the present invention.

One embodiment of the present invention including subpixels of varying size is shown in FIG. 10. A small portion of a display panel 100 is shown, including four pixels. In particular, distinct types of pixels 102 and 104 each contain green and white subpixel elements (102G, 104G and 102W, 104W) that are located in the same position, and are the same size, within each pixel. However 102 contains a red subpixel 102R, but not a blue subpixel, whereas 104 contains a blue subpixel 104B, but not a red subpixel. Note that the size of the red and blue subpixels is the same, and both are larger than the G or W subpixels. The position of the red and blue subpixels alternates as shown previously in FIG. 9. This results in a pattern that is classified as neither stripe nor quad, but does adhere to the design principles of high luminance subpixel alignment and low luminance subpixel interchange of the present invention. As in the previous described embodiments, the sequences of subpixels in alternating and interleaving rows repeat across the height of the display. It should be noted that since there are fewer red and blue light emitting subpixels than white and green light emitting subpixels within the pattern depicted in FIG. 10, the use of this pattern may require these elements to have twice the area as they would have in the patterns shown in FIG. 4, FIG. 5 or FIG. 6 in order to achieve proper color balance or to balance the lifetimes of the subpixels.

Figure 11:
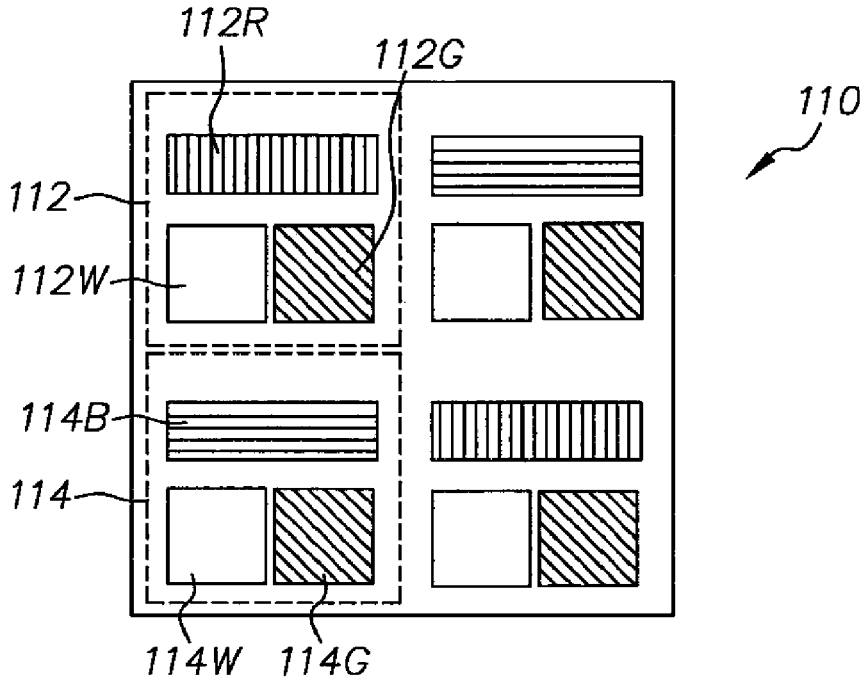
FIG. 11 is a schematic diagram showing an arrangement of light emitting subpixel elements according to another embodiment of the present invention.

The orientation of the pattern shown in FIG. 10 can be rotated. One such orientation of this pattern is shown in FIG. 11. FIG. 11 shows a small portion of a display panel 110, including four pixels. As was shown in FIG. 10, each pixel consists of white W, green G, and either one red R or one blue B light emitting subpixel element, but not both. For example, a pixel 112 consists of a red 112R, green 112G, and white 112W light emitting subpixel element. A neighboring pixel 114 consists of a blue 114B, green 114G and white 114W light emitting subpixel elements. This pattern provides white (e.g., 112W and 114W) and green (e.g., 112G and 114G) light emitting subpixel elements that are positioned at the same locations within each pixel while the position of red 112R and blue 114B light emitting subpixel elements are the same in the two pixels. As in the previous described embodiments, the sequences of subpixels in alternating and interleaving rows repeat across the height of the display.

Figure 12:
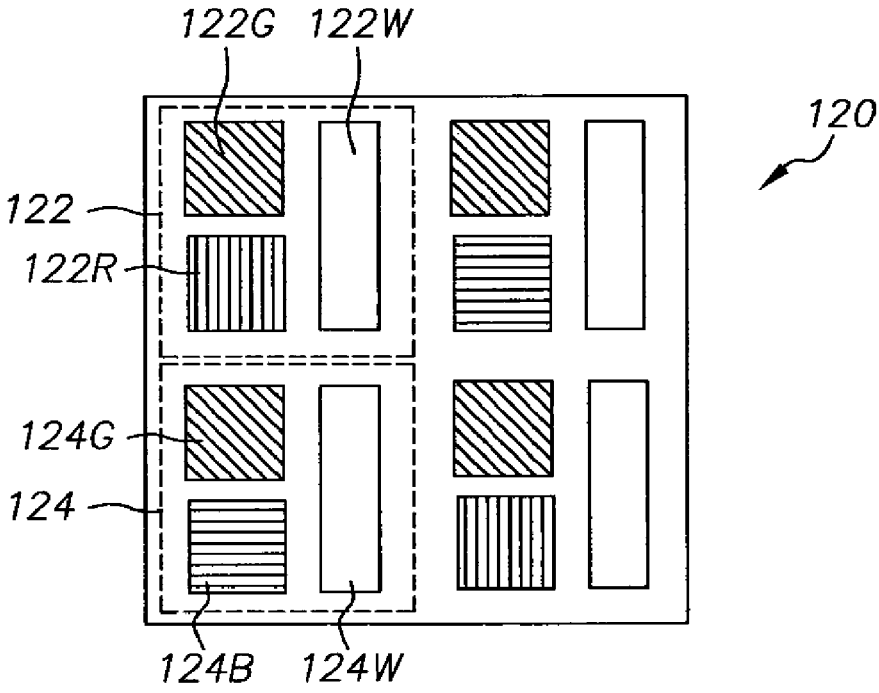
FIG. 12 is a schematic diagram showing an arrangement of light emitting subpixel elements according to another embodiment of the present invention.

Another embodiment of the invention demonstrating varying subpixel sizes is shown in FIG. 12. A small portion of a display panel 120 is shown, including four pixels. In particular, distinct types of pixels 122 and 124 each contain green and white subpixel elements (122G, 124G and 122W, 124W) that are located in the same position, within each pixel. However 122 contains a red subpixel 122R, but not a blue subpixel, whereas 124 contains a blue subpixel 124B, but not a red subpixel. Note that the size of the red, green and blue subpixels are the same, and all three are smaller than the W subpixel. The position of the red and blue subpixels alternates as demonstrated previously. As in the previous described embodiments, the sequences of subpixels in alternating and interleaving rows repeat across the height of the display.

Figure 13:
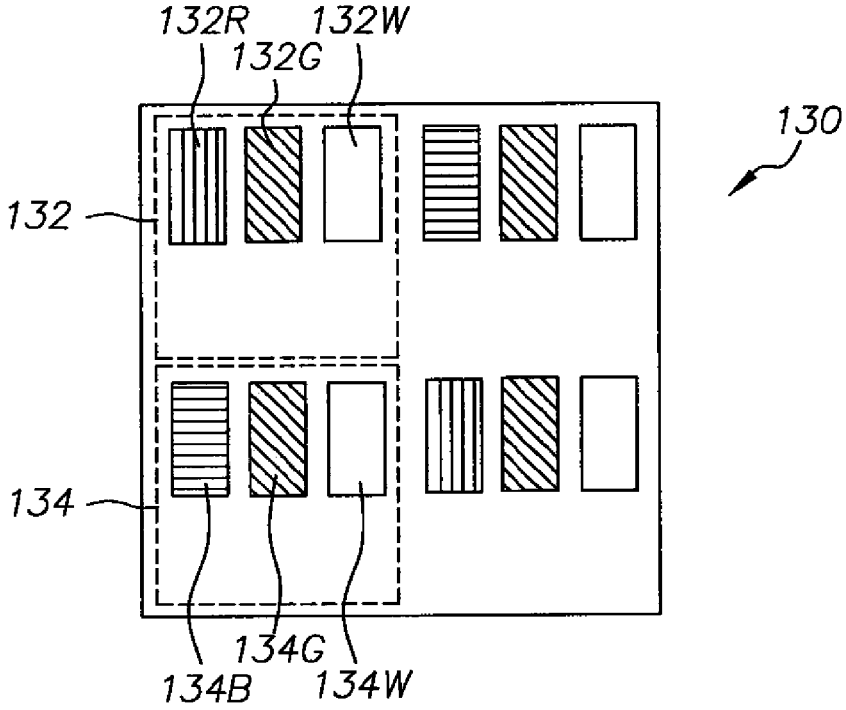
FIG. 13 is a schematic diagram showing an arrangement of light emitting subpixel elements according to another embodiment of the present invention.

The previous embodiments of the invention have demonstrated instances in which the combined subpixel aperture ratio is at or near the maximum, that is, nearly all available space within the pixel is emitting. The subpixel aperture ratio is defined as the ratio of the active or emitting subpixel area to the total pixel area. For various reasons, such as the need to include supporting circuitry, the full area of the pixel will not be actively emitting radiation. An embodiment of the invention demonstrating a much smaller than maximum subpixel aperture ratio is shown in FIG. 13. This embodiment is completely analogous in its arrangement to that shown in FIG. 9, the difference being the much smaller (roughly one half as large) subpixel aperture ratio. The white (132W and 134W) and green (132G and 134G) light emitting subpixel elements are located at the same position within each pixel. The red 132R light emitting subpixel element is located in every other pixel. The blue 134B light emitting subpixel element is also located in every other pixel and the blue 134B light emitting subpixel element is located at the same location in pixel 134 as the red 132R light emitting subpixel element is located in pixel 132. It will be appreciated that the invention can be readily applied to a continuum of other subpixel aperture ratios. As in the previous described embodiments, the sequences of subpixels in alternating and interleaving rows repeat across the height of the display.

Figure 14:
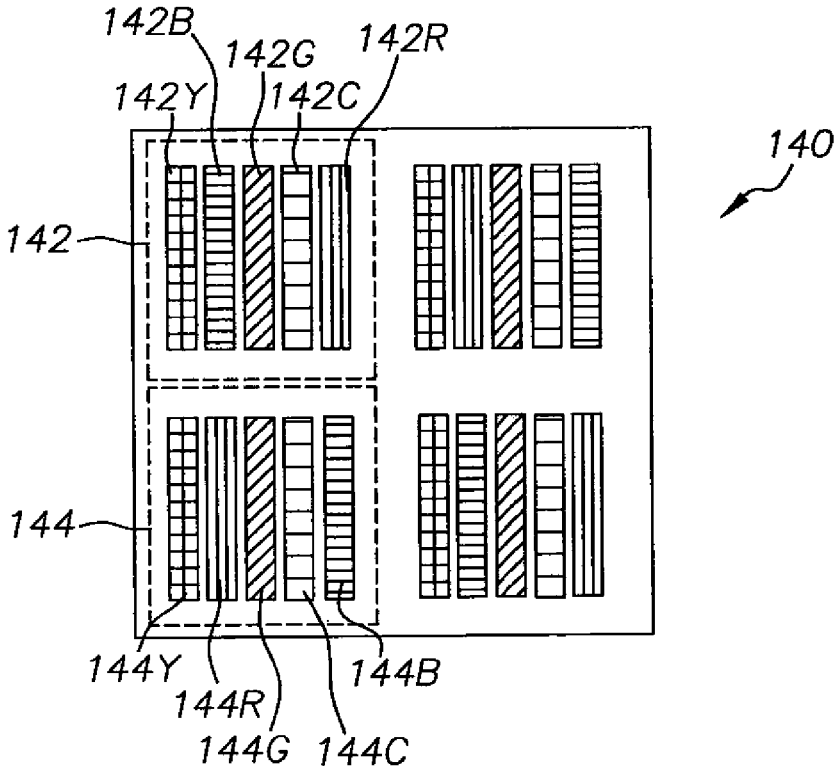
FIG. 14 is a schematic diagram showing an arrangement of light emitting subpixel elements according to one embodiment of the present invention.

The above discussed display embodiments each employ combinations of four different colored subpixels. Alternate embodiments of the invention for five light emitting subpixel elements are now demonstrated. FIG. 14 shows a small portion of a display panel 140, including four pixels. In particular, pixel 142 contains, from left to right, a yellow emitting subpixel 142Y, blue emitting subpixel 142B, green emitting subpixel 142G, cyan emitting subpixel 142C, and red emitting subpixel 142R. Subpixels such as yellow and cyan may be used to enhance the efficiency, lifetime and/or color gamut of a display device. Pixel 144 contains the same selection of colored emitters. However, in 144 the arrangement is, again from left to right, yellow (144Y), red (144R), green (144G), cyan (144C) and blue (144B). As before, the subpixels carrying the majority of the luminance information, i.e. green, yellow and cyan, retain their relative position and alignment within the pixel, while the other subpixels alternate positions. As in the previous described embodiments, the sequences of subpixels in alternating and interleaving rows repeat across the height of the display.

Figure 15:
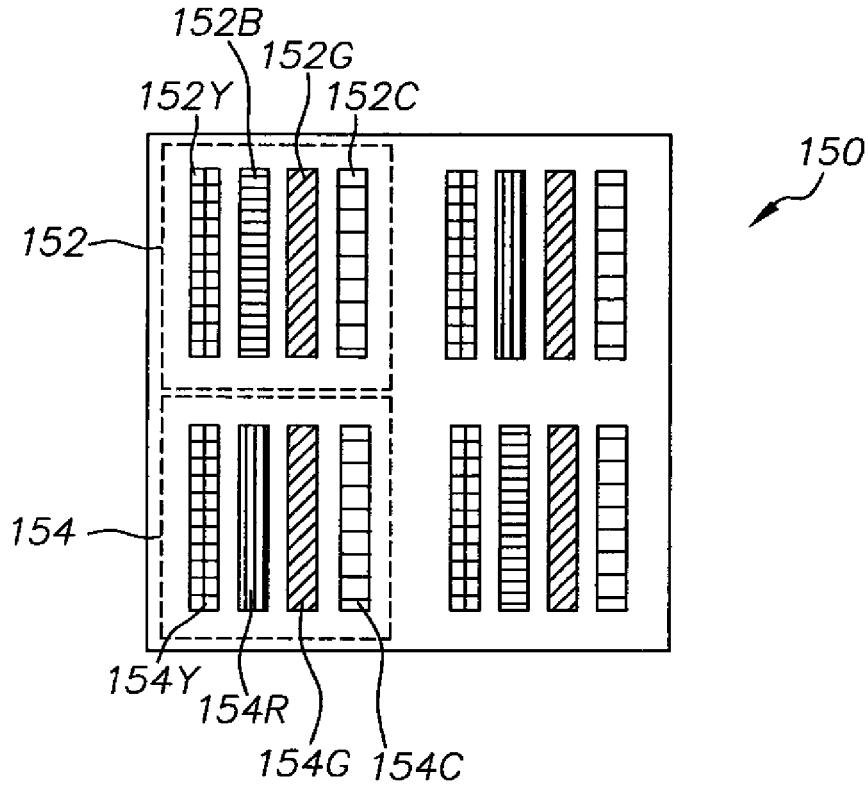
FIG. 15 is a schematic diagram showing an arrangement of light emitting subpixel elements according to another embodiment of the present invention.

An alternate embodiment of a five emitter striped display with subsampling of the low-luminance red and blue subpixel elements is shown in FIG. 15. A small portion of a display 150 is shown, including four pixels. In particular, pixel 152 contains a yellow subpixel 152Y, blue subpixel 152B, green subpixel 152G, and cyan subpixel 152C, but does not contain a red subpixel. Pixel 154 contains a yellow subpixel 154Y, red subpixel 154R, green subpixel 154G, and cyan subpixel 154C, but does not contain a blue subpixel. The red and blue subpixels are seen to alternate, in analogy with FIG. 9 for the four emitter display. As in the previous described embodiments, the sequences of subpixels in alternating and interleaving rows repeat across the height of the display.

Figure 16:
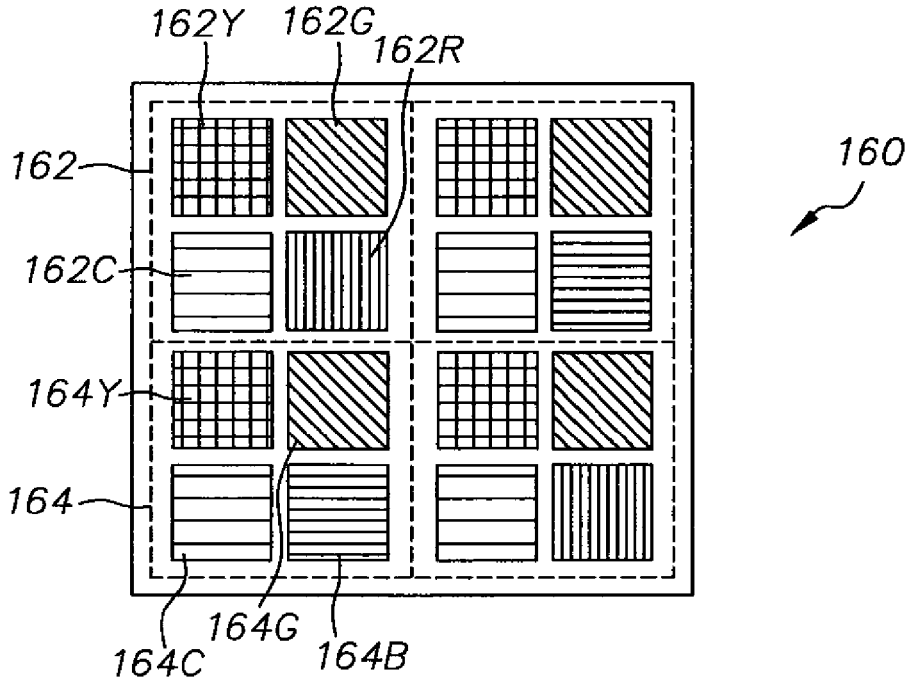
FIG. 16 is a schematic diagram showing an arrangement of light emitting subpixel elements according to another embodiment of the present invention.

An alternate embodiment for a five emitter display is shown in FIG. 16. A small portion of a display panel 160 is shown, including four pixels. In particular, pixel 162 contains a yellow subpixel 162Y, green subpixel 162G, cyan subpixel 162C and red subpixel 162R. Pixel 164 contains a yellow subpixel 164Y, green subpixel 164G and cyan subpixel 164C, but contains a blue subpixel 164B rather than a red subpixel. As before, the high-luminance subpixels retain their positions while the low-luminance red and blue subpixels appear in every other group of subpixels. As in the previous described embodiments, the sequences of subpixels in alternating and interleaving rows repeat across the height of the display.

Figure 17:
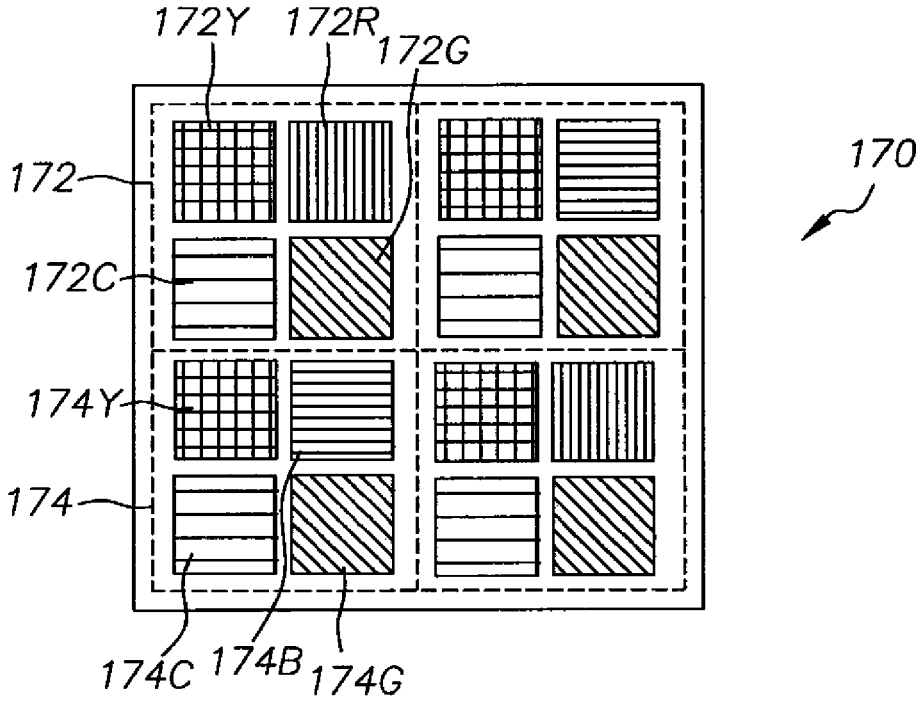
FIG. 17 is a schematic diagram showing an arrangement of light emitting subpixel elements according to another embodiment of the present invention.

FIG. 17 shows an alternate embodiment to that shown in FIG. 16. A small portion of a display panel 170 is shown, including four pixels. In particular, pixel 172 contains a yellow subpixel 172Y, red subpixel 172R, cyan subpixel 172C and green subpixel 172G. Pixel 174 contains a yellow subpixel 174Y, blue subpixel 174B, cyan subpixel 174C, and green subpixel 174G. As before, the high-luminance subpixels retain their positions while the low-luminance red and blue subpixels appear in every other group of subpixels. As in the previous described embodiments, the sequences of subpixels in alternating and interleaving rows repeat across the height of the display.

Figure 18:
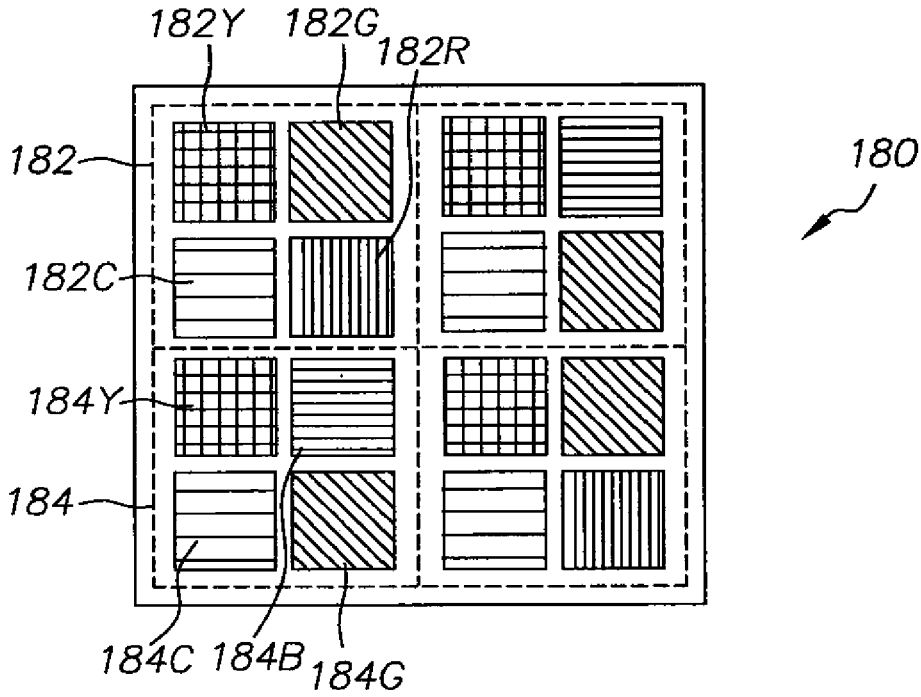
FIG. 18 is a schematic diagram showing an arrangement of light emitting subpixel elements according to another embodiment of the present invention.

FIG. 18 shows an alternate embodiment for a five emitter display. A small portion of a display panel 180 is shown, including four pixels. In particular, pixel 182 contains a yellow subpixel 182Y, green subpixel 182G, cyan subpixel 182C and red subpixel 182R. Pixel 184 contains a yellow subpixel 184Y, blue subpixel 184B, cyan subpixel 184C, and green subpixel 184G. In this case, the yellow and cyan are treated as the high-luminance subpixels, while the red, green and blue are treated as the low-luminance subpixels. The red and blue are subsampled, and all three of the red, green and blue alternate positions between groups. As in the previous described embodiments, the sequences of subpixels in alternating and interleaving rows repeat across the height of the display.

Figure 19:
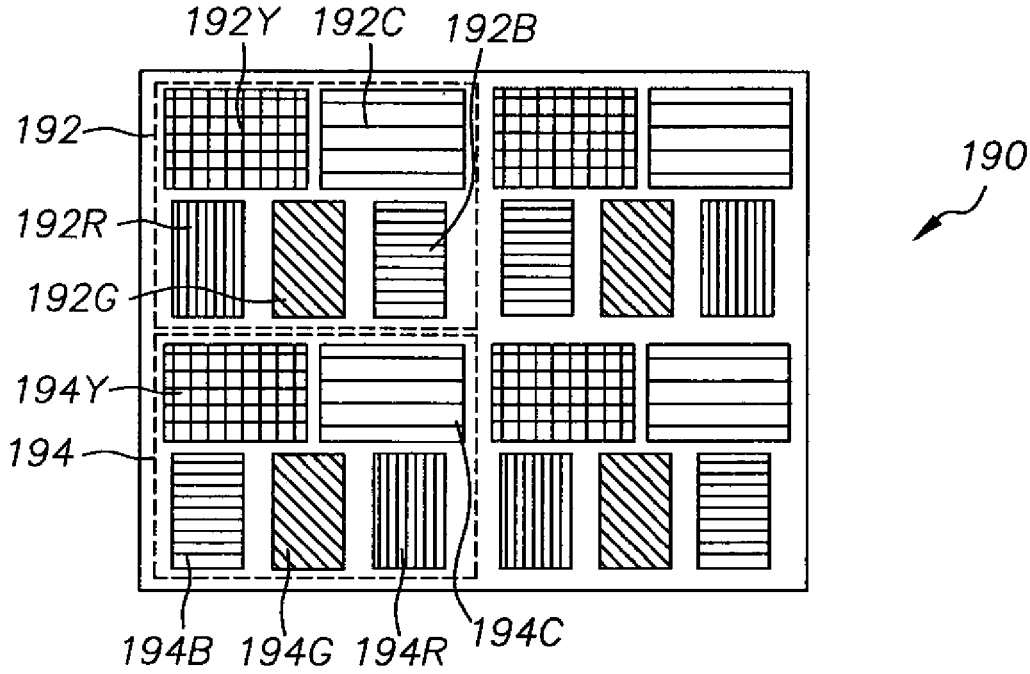
FIG. 19 is a schematic diagram showing an arrangement of light emitting subpixel elements according to another embodiment of the present invention.

Other five emitter arrangements and subpixel geometries are possible within the scope of the invention. FIG. 19 shows a small portion of a display 190, including four pixels. In particular, pixel 192 contains a yellow subpixel 192Y and a cyan subpixel 192C, which are rectangles whose longer axes are aligned parallel to the horizontal. Within the same grouping, red subpixel 192R, green subpixel 192G and blue subpixel 192B are aligned with their longer axes parallel to the vertical. Pixel 194 contains the same colored emitters, however the blue subpixel 194B and red subpixel 194R have exchanged positions relative to the positions of 192R and 192B, since they are the low-luminance subpixels, while the high-luminance subpixels have retained their relative positions. As in the previous described embodiments, the sequences of subpixels in alternating and interleaving rows repeat across the height of the display.

Figure 20:
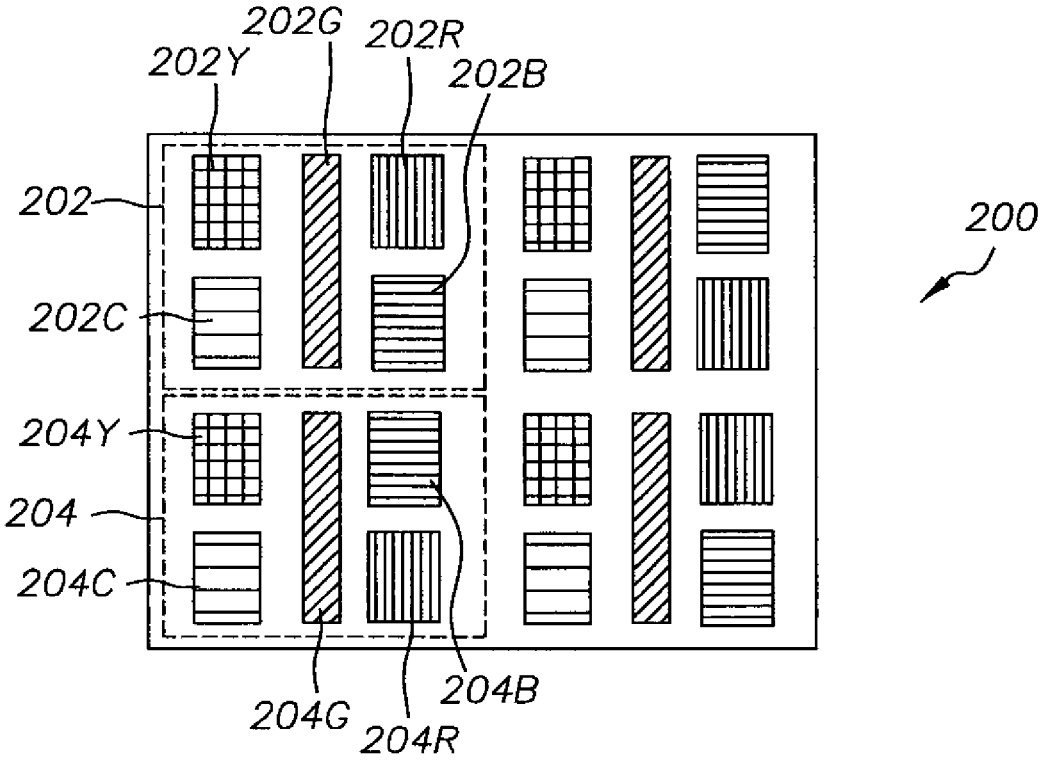
FIG. 20 is a schematic diagram showing an arrangement of light emitting subpixel elements according to another embodiment of the present invention.

FIG. 20 shows a five emitter embodiment consisting of a mixture of rectangular and stripe subpixels. A small portion of a display 200 is shown, including four pixels. In particular, pixel 202 contains four rectangular subpixels, yellow 202Y, red 202R, cyan 202C and blue 202B, plus a green stripe 202G in the center. Below this group, pixel 204 contains four more rectangular emitters of the same color, along with a central green stripe, however the red subpixel 204R and blue subpixel 204B have exchanged positions relative to the positions of 202R and 202B, since they are the low-luminance subpixels, while the high-luminance subpixels have retained their relative positions. As in the previous described embodiments, the sequences of subpixels in alternating and interleaving rows repeat across the height of the display.

The present invention can be employed in most OLED device configurations that employ four or more different colored OLED subpixel elements, and that include three or more OLED subpixel elements per pixel. These include very unsophisticated structures comprising a separate anode and cathode per OLED to more sophisticated devices, such as passive matrix displays having orthogonal arrays of anodes and cathodes to form pixels, and active-matrix displays where each pixel is controlled independently, for example, with a thin film transistor (TFT). The present invention can be employed in either a top or bottom emitting OLED device of the types known in the prior art. Such devices employing four or more subpixel elements have been described, e.g., in copending, commonly assigned U.S. Ser. No. 10/320,195 (filed Dec. 16, 2002), Ser. No. 10/387,953 (filed Mar. 13, 2003), Ser. No. 10/812629 (filed Mar. 29, 2004) and Ser. No. 10/812,786 (filed Mar. 29, 2004), the disclosures of which are hereby incorporated by reference herein.

Similar patterns may alternatively be employed in other OLED display devices containing four or more light emitting subpixel elements in which two light emitting subpixel elements are higher in luminance information than the others. For example, copending, commonly assigned U.S. Ser. No. 10/812,787 (filed Mar. 29, 2004) describes an OLED device having red, green, blue and cyan light emitting subpixel elements. In such a display structure, the green and cyan light emitting subpixel elements provide the preponderance of luminance while the blue and red light emitting subpixel elements once again provide significantly less luminance information.

While the invention is particularly applicable, and has been particularly described in connection with the arrangement of subpixel elements employed in light emitting displays such as OLED displays, Plasma or Field Emission displays, the described subpixel arrangements will also be applicable to improving image quality in non-emitting (e.g., transmissive, transflective or reflective) display devices employing liquid crystal, electrowetting or other technologies. Further, while the invention has been described in connection with particular four and five subpixel arrangements, it will be apparent to the artisan that the invention as described and claimed will also be applicable to display devices employing six or even more different types of subpixels. Further, it will be apparent to the artisan that while specific pixel orientations have been illustrated for various embodiments, further variations within the scope of the described and claimed invention may employ alternative orientations of the subpixels.

A display system including the display panels as described herein may employ a method and apparatus to convert a three color signal to a four or more color signal appropriate for presentation on a display panel having four or more light emitting subpixel elements emitting different colors methods such as those described in copending, commonly assigned U.S. Ser. No. 10/607,374 (filed Jun. 26, 2003) and Ser. No. 10/812,787 (filed Mar. 29, 2004) may be employed to complete this conversion. Such conversion processes may be employed in software, ASIC, or other hardware capable of performing the conversion.

The invention has been described in detail with particular reference to certain preferred embodiments thereof, but it will be understood that variations and modifications can be effected within the spirit and scope of the invention.

PARTS LIST

R red subpixel
G green subpixel
B blue subpixel
W white subpixel
10 section of a display panel
12 display pixel
14 display pixel
16 display pixel
18 display pixel
20 section of a display panel
22 display pixel
30 section of a display panel
32 display pixel
40 section of a display panel
42G green subpixel
42B blue subpixel
42W white subpixel
44 display pixel
44R red subpixel
44G green subpixel
44B blue subpixel
44W white subpixel
50 section of a display panel
52 display pixel
52R red subpixel
52G green subpixel
52B blue subpixel
52W white subpixel
54 display pixel
54R red subpixel
54G green subpixel
54B blue subpixel
54W white subpixel
60 section of a display panel
62 display pixel
62R red subpixel
62G green subpixel
62B blue subpixel
62W white subpixel
64 display pixel
64R red subpixel
64G green subpixel
64B blue subpixel
64W white subpixel
70 section of a display panel
72 display pixel
72R red subpixel
72G green subpixel
72B blue subpixel
72W white subpixel
74 display pixel
74R red subpixel
74G green subpixel
74B blue subpixel
74W white subpixel
80 section of a display panel
82 display pixel
82R red subpixel
82G green subpixel
82B blue subpixel
82W white subpixel
84 display pixel
84R red subpixel
84G green subpixel
84B blue subpixel
84W white subpixel
90 section of a display panel
92 display panel
92R red subpixel
92G green subpixel
92B blue subpixel
92W white subpixel
94 display pixel
94G green subpixel
94B blue subpixel
94W white subpixel
100 section of a display panel
102 display panel
102R red subpixel
102G green subpixel
102W white subpixel
104 display pixel
104G green subpixel
104B blue subpixel
194 white subpixel
110 section of a display panel
112 display pixel
112R red subpixel
112G green subpixel
112W white subpixel
114 display pixel
114G green subpixel
114B blue subpixel
114W white subpixel
120 section of a display panel
122 display pixel
122R red subpixel
1123G green subpixel
122W white subpixel

124 display pixel
124G green subpixel
124B blue subpixel
124W white subpixel
130 section of a display panel
132 display pixel
132R red subpixel
132G green subpixel
132W white subpixel
134 display pixel
134G green subpixel
134B blue subpixel
134W white subpixel
140 section of a display panel
142 display pixel
142R red subpixel
142G green subpixel
142B blue subpixel
142Y yellow subpixel
142C cyan subpixel
144 display pixel
144G green subpixel
144B blue subpixel
144R red subpixel
144Y yellow subpixel
144C cyan subpixel
150 section of a display panel
152 display pixel
152G green subpixel
152B blue subpixel
152Y yellow subpixel
152C cyan subpixel
154 display pixel
154G green subpixel
154R red subpixel
154Y yellow subpixel
154C cyan subpixel
160 section of a display panel
162 display pixel
162R red subpixel
162G green subpixel
162Y yellow subpixel
162C cyan subpixel
164 display pixel
164G green subpixel
164B blue subpixel
164Y yellow subpixel
164C cyan subpixel
170 section of a display panel
172 display pixel
172R red subpixel
172G green subpixel
172Y yellow subpixel
172C cyan subpixel
174 display pixel
174G green subpixel
174B blue subpixel
174Y yellow subpixel
174C cyan subpixel
180 section of a display panel
182 display pixel
182R red subpixel
182G green subpixel
182Y yellow subpixel
182C cyan subpixel
184 display pixel
184G green subpixel
184B blue subpixel
184Y yellow subpixel
184C cyan subpixel
190 section of a display panel
192 display pixel
192R red subpixel
192G green subpixel
192B blue subpixel
192Y yellow subpixel
192C cyan subpixel
194 display pixel
194G green subpixel
194B blue subpixel
194R red subpixel
194Y yellow subpixel
194C cyan subpixel

The invention claimed is:

1. A color display device, comprising: an array of subpixels of at least four different colors, including at least two relatively higher luminous color subpixels and at least two relatively lower luminous color subpixels, wherein the subpixels are arranged into groups forming at least two distinct types of pixels, each pixel type including the two relatively higher luminous color subpixels and at least one of the two relatively lower luminous color subpixels, and wherein the pixel types are arranged in a pattern such that the relative locations of the two relatively higher luminous color subpixels in each pixel is repeated in adjacent pixels, and the relative location of at least one of the two relatively lower luminance color subpixels is not repeated in at least one adjacent pixel;

wherein alternating rows of pixels in the display comprise a first pixel type wherein the subpixels are positioned in a sequence of red, green, white and blue rectangles, whose long axes are oriented vertically, and whose long axes are parallel to each other, said sequence of subpixels in said alternating rows of pixels repeating across the width of the display;

interleaving rows of pixels between the alternating rows in the display comprise a second pixel type wherein the subpixels are positioned in a sequence of blue, green, white and red rectangles, whose long axes are oriented vertically, and whose long axes are parallel to each other, said sequence of subpixels in said interleaving rows of pixels repeating across the width of the display; and said sequences of subpixels in alternating and interleaving rows repeating across the height of the display.

2. The color display device of claim 1, wherein the rectangular subpixels are of equal width and length.

3. The color display device of claim 1, wherein the rectangular subpixels are of different width or length.

* * * * *